US006782894B2

(12) United States Patent
Shum

(10) Patent No.: US 6,782,894 B2
(45) Date of Patent: Aug. 31, 2004

(54) FINGERNAIL DECORATING METHOD

(75) Inventor: Eva Shum, Markham (CA)

(73) Assignee: Eva Agnes Shum, Markham (CA)

( * ) Notice: Subject to any disclaimer, the term of this patent is extended or adjusted under 35 U.S.C. 154(b) by 0 days.

(21) Appl. No.: 09/971,208

(22) Filed: Oct. 4, 2001

(65) Prior Publication Data

US 2003/0024541 A1 Feb. 6, 2003

(51) Int. Cl.[7] ..... A45D 29/00
(52) U.S. Cl. ..... 132/200
(58) Field of Search ..... 132/200, 218, 132/73, 73.5, 75.3, 75.6, 76.4, 313, 317, 318, 320; 15/105, 114, 118, 244.1; D28/56, 57, 62

(56) References Cited

U.S. PATENT DOCUMENTS 1,464,642 A * 8/1923 Bruce ..... 132/75.3
RE16,869 E * 2/1928 Goldman ..... 418/238
1,856,854 A * 5/1932 Schwanhausser ..... 132/75.3
2,035,323 A * 3/1936 Langdon ..... 132/75.3
2,162,155 A * 6/1939 Calvin ..... 132/73
2,199,207 A * 4/1940 Nolan ..... 132/73
2,370,414 A * 2/1945 Ostrander ..... 15/105
2,538,076 A * 1/1951 Bates ..... 15/210.1
3,885,578 A * 5/1975 Hicks ..... 132/73
4,628,564 A * 12/1986 Youssef ..... 15/167 R
D291,374 S * 8/1987 Korper ..... D28/7
4,718,889 A * 1/1988 Blasius, Jr. et al. ..... 604/1
4,724,568 A * 2/1988 Englehardt ..... 15/118
4,842,132 A * 6/1989 Wells ..... 206/229
5,044,383 A * 9/1991 Alessio et al. ..... 132/73
5,077,857 A * 1/1992 Sellers ..... 15/107
5,097,853 A * 3/1992 Nehashi ..... 132/320
5,176,754 A * 1/1993 Hirzel ..... 118/258
5,269,330 A * 12/1993 Hayes ..... 132/200
5,351,356 A * 10/1994 Townsend, Jr. ..... 15/114
5,762,077 A * 6/1998 Griffiths, Jr. ..... 132/74.5
5,778,900 A * 7/1998 Bate ..... 132/73
5,881,742 A * 3/1999 Hunsberger ..... 132/297
5,890,495 A * 4/1999 Cain ..... 132/73
5,928,457 A * 7/1999 Engler ..... 156/297
5,931,166 A * 8/1999 Weber et al. ..... 132/73
5,996,591 A * 12/1999 Landa et al. ..... 132/200
6,035,860 A * 3/2000 Mombourquette ..... 132/200
6,185,778 B1 * 2/2001 Ornstedt ..... 15/114
6,189,539 B1 * 2/2001 Mitchell ..... 132/73
6,192,892 B1 * 2/2001 Resler ..... 132/200
6,213,131 B1 * 4/2001 Vien et al. ..... 132/285
6,217,935 B1 * 4/2001 Hubbell ..... 427/142

* cited by examiner

*Primary Examiner*—Eduardo C. Robert
*Assistant Examiner*—David Comstock

(57) ABSTRACT

A method of decorating fingernails is disclosed. An applicator having a foam brush on one end and a bristle brush on the other end is obtained. The foam brush has a non-uniform cell structure and the bristle brush is adapted to apply a uniform coating of nail polish. The bristle brush is used to apply a uniform coating of nail polish of one color. Then, the foam brush is partially saturated in nail polish of a color different from the color of the uniform coating. The foam brush is repeatedly pressed against the nail. Due to the non-uniform cell structure of the foam brush, pools of nail polish of different sizes and thicknesses are deposited onto the nail. Some of the pools are thin to allow the color of the uniform coating to be visible therethrough. The uniform coating is left exposed in several locations. Thus, a mottled effect is produced on the fingernail.

1 Claim, 4 Drawing Sheets

FINGERNAIL DECORATING METHOD

FIELD OF THE INVENTION

The invention relates to foam applicator brushes for applying coloured nail polish to finger nails.

BACKGROUND OF THE INVENTION

Since ancient times, women have decorated their finger nails by applying coloured polishes. These polishes, when hardened, gave the finger nails a decorative and appealing appearance. Traditionally, these polishes were available in a few colours which were applied to the finger nails as smooth uniform coatings. A variety of brushes and foam applicators have been used to apply these nail polishes to finger nails. These applicators generally consisted of small bristled brushes having substantially uniform bristles. These applicators were specifically designed to apply the nail polish as uniformly as possible to create a smooth and uniform coating. The end result was a finger nail having a reflective uniform colour.

As women's fashions changed, so have attitudes concerning the decorating of finger nails. Nail polishes are now available in a great variety of colours and textures. Fanciful nail decorations have also become very popular. These decorations often employ geometric designs formed from different coloured nail polishes. These designs were generally painted onto the surface of the finger nails using smaller versions of traditional nail polish applicators. While these newer nail painting techniques yield appealing designs, they are time consuming and difficult to reproduce. The average woman, not being trained to reproduce these designs, could not easily decorate her own finger nails in as fanciful a fashion as she may have desired. Furthermore, traditional nail polish applicators were not well adapted to create fanciful finger nail designs.

SUMMARY OF THE INVENTION

The present invention addresses the needs of modern women by providing them with a nail polish application tool which permits them to easily generate highly decorative finger nail finishes with a minimum of effort. The applicator tool consists of an elongated member having a nail polish applicator at one end. The nail polish applicator preferably consists of a foam pad adapted to apply the nail polish in a non-uniform manner. The foam pad preferably has a non-uniform density and consists of a plurality of cells of different sizes.

The present invention also provides a method for women to decorate their finger nails in a fanciful and appealing way. The method consists of first applying a first coat of nail polish onto the finger nails using a first nail polish applicator which is adapted to apply the first coat in a substantially uniform fashion. The women then applies a second coat of nail polish having a different colour on to the hardened first coat using an applicator tool adapted to apply the second coat in a non-uniform fashion. The end result is a fanciful and appealing design consisting of more than one colour.

With the foregoing in view, and other advantages as will become apparent to those skilled in the art to which this invention relates as this specification proceeds, the invention is herein described by reference to the accompanying drawings forming a part hereof, which includes a description of the preferred typical embodiment of the principles of the present invention.

DESCRIPTION OF THE DRAWINGS

In the drawings like characters of reference indicate corresponding parts in the different figures.

DETAILED DESCRIPTION OF THE INVENTION

Figure 1:
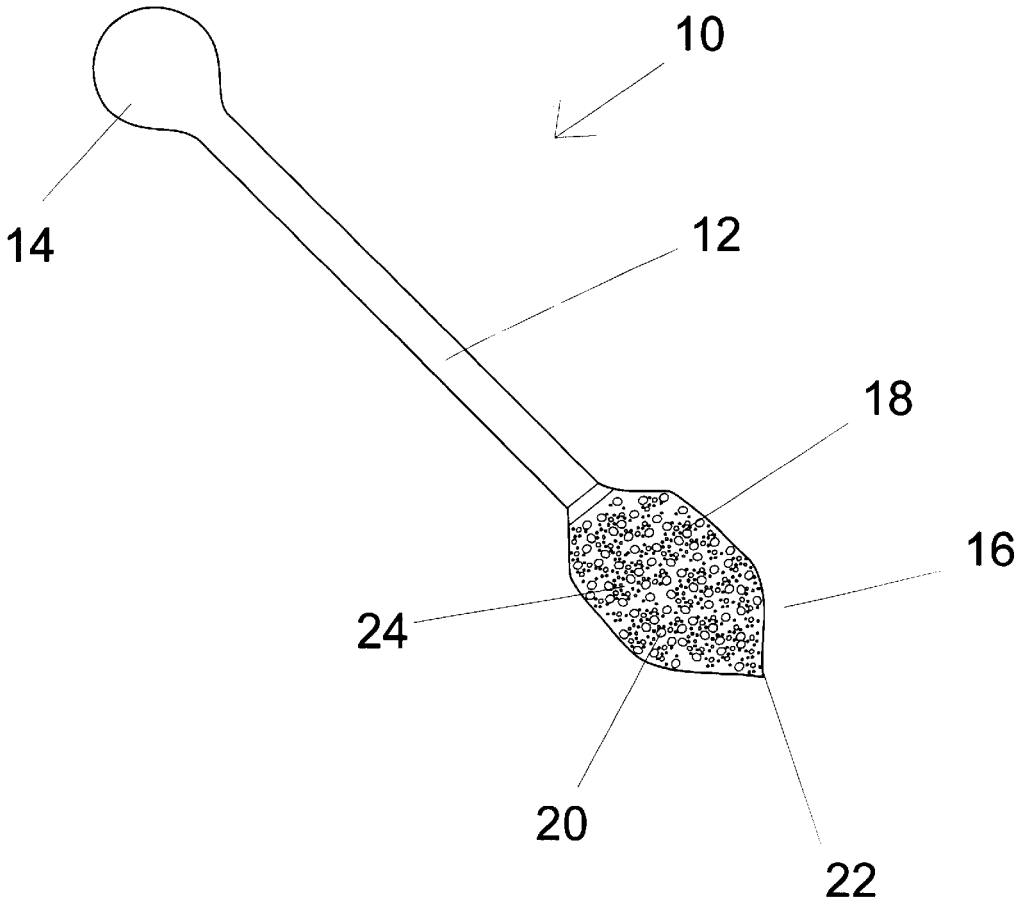
FIG. 1 is a side view of a nail polish applicator made in accordance with the present invention.

Referring firstly to FIG. 1, a nail polish applicator made in accordance with the present invention, shown generally as item 10, consists of an elongated member 12 having opposite ends 14 and 16. In the specific embodiment shown in FIG. 1, end 14 is formed into a handle which is adapted to be easily held by the user. Opposite end 16 of applicator tool 10 has a nail polish applicator pad 18. Preferably, applicator pad 18 consists of a foam material having a plurality of cells 20 of differing sizes. The foam forming applicator pad 18 preferably has a non-uniform density, such that when applied to the surface of a finger nail (not shown), portions of the foam pad contact the surface with greater force than other portions do. It has been discovered that natural sponge is an ideal material for forming foam pad 18 since it has a non-uniform density and a non-uniform cell structure.

Foam pad 18 has pointed end 22 and thicker portion 24. Pointed end 22 permits the user to apply nail polish in a more precise manner. Wider portion 24, having a larger surface area, permits the user to apply larger quantities of nail polish at one time. Preferably, pad 18 is approximately conical in configuration.

Figure 2:
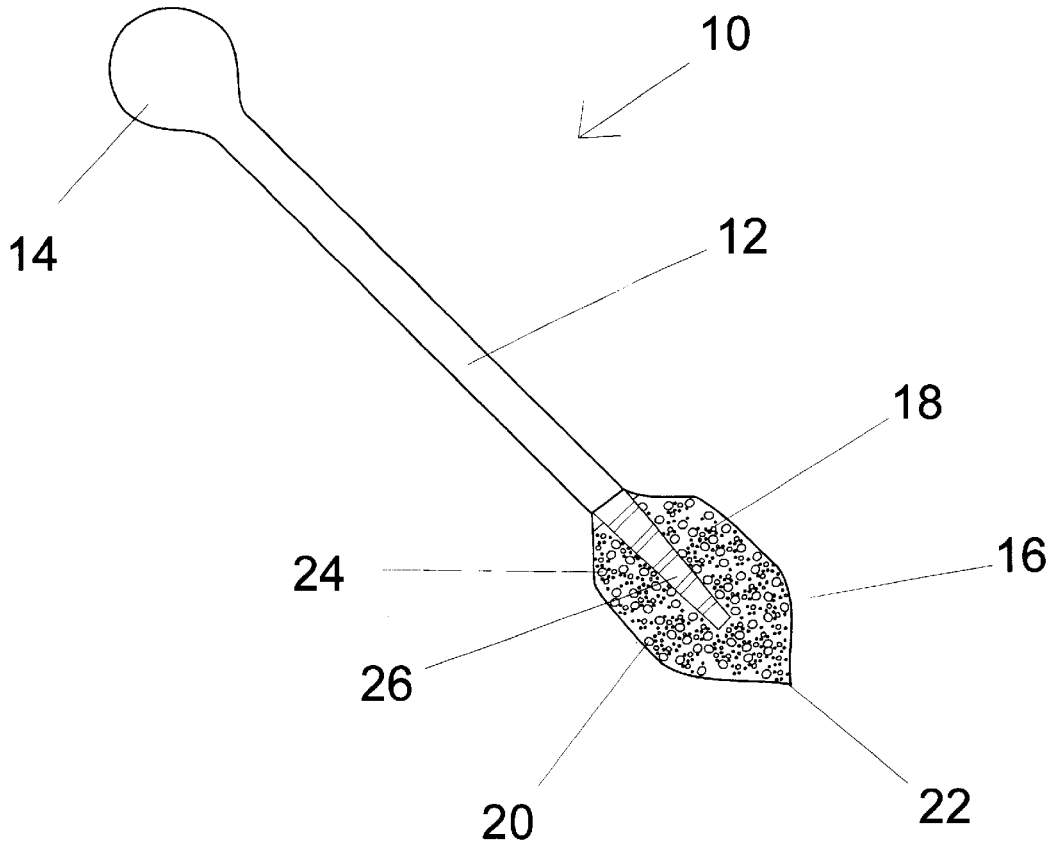
FIG. 2 is a side view partly in cross section of the nail polish applicator of FIG. 1.

Referring now to FIG. 2, foam pad 18 is reinforced by a longitudinally extending resilient core 26. Preferably, core 26 is an extension of elongated member 12, and is made of a plastic material. Foam pad 18 is adhered to resilient core 26 by an adhesive or other means known generally in the art.

Figure 6:
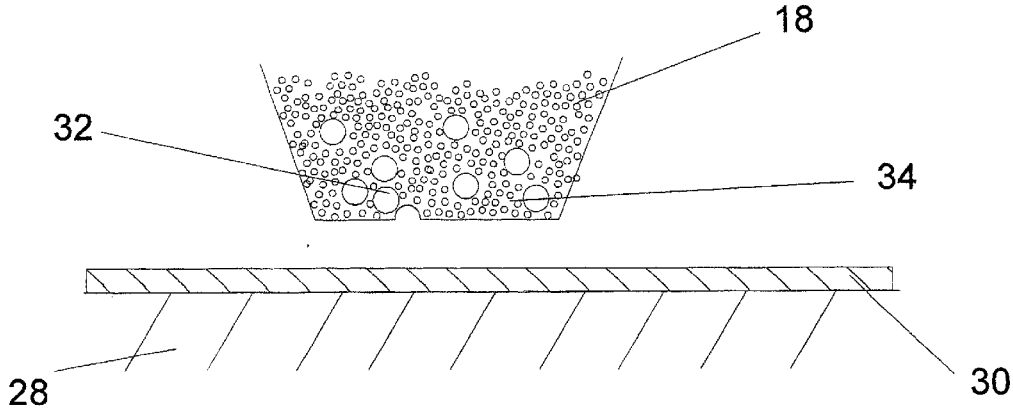
FIG. 6 is a schematic view in cross section of a finger nail about to be decorated with the applicator pad portion of the present invention.
Figure 7:
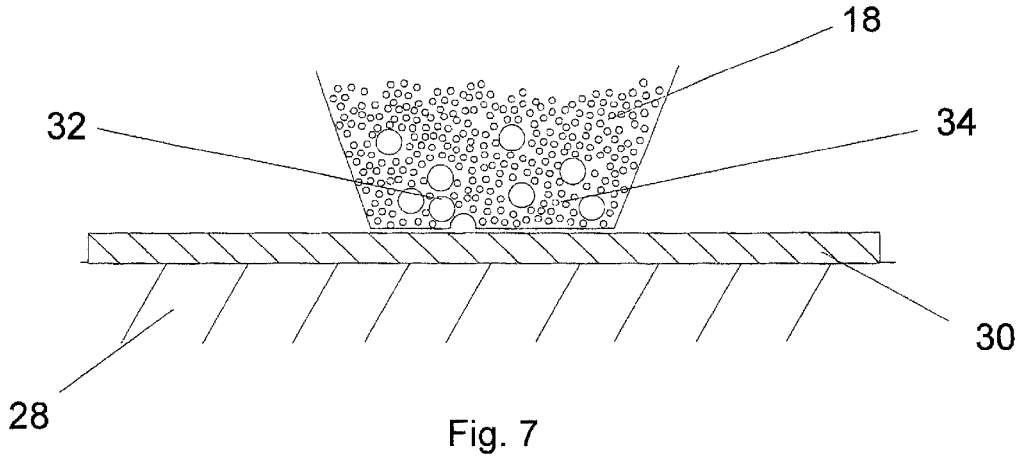
FIG. 7 is a schematic view in cross section of a finger nail being decorated with the applicator pad portion of the present invention.
Figure 8:
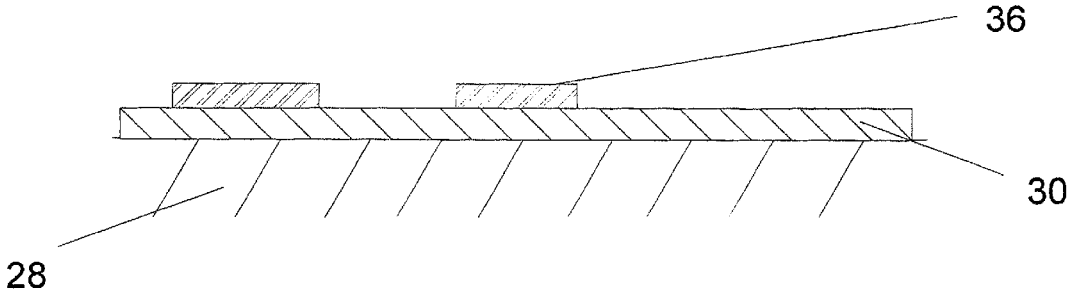
FIG. 8 is a schematic view in cross section of a finger nail after being decorated with the applicator pad portion of the present invention.

Referring now to FIGS. 6, 7 and 8, the method of decorating finger nails using the present invention shall now be discussed. Finger nail 28 is first decorated with a coating of nail polish 30 and permitted to harden. Nail polish 30 is preferably applied as a uniform coating such that it is of substantially uniform colour and thickness. To obtain a uniform application of nail polish 30, the user would use a standard nail polish applicator (not shown) such as a brush. Applicator pad 18 is then partially saturated in a nail polish solution (not shown) having a different colour than nail polish 30. Applicator pad 18 is then repeatedly pressed against finger nail 28. Since applicator pad 18 has a non-uniform density and cell structure, portion 32 of the applicator pad (having a lower density) will press against nail 28 with less force than portion 34 of the applicator pad (having a relatively higher density). As a result, portions 32 and 34 will deposit different quantities of nail polish. The end result, as seen in FIG. 8, will be a mottled affect with a non-uniform application of nail polish 36 on top of nail polish 30. Pad 18 deposits nail polish 36 in a non-uniform fashion leaving several pools of nail polish 36 of different sizes and thicknesses. Where nail polish 36 is applied as a very thin pool, the colour of nail polish 30 will partially show through. In several locations, nail polish 30 will be left exposed.

Figure 3:
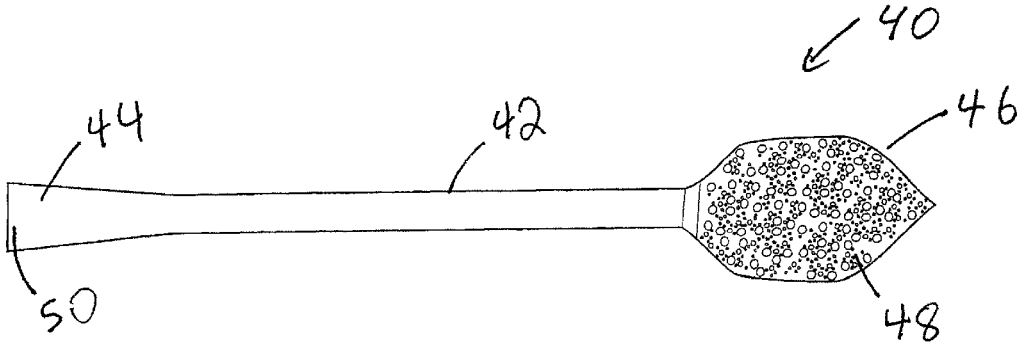
FIG. 3 is a side view of another embodiment of a nail polish applicator made in accordance with the present invention.

The present invention can be incorporated into nail decorating tools which serve more than one function. FIG. 3 illustrates a nail decorating tool which incorporates both a nail scrapper (to remove unwanted hardened nail polish) and a non-uniform nail polish applicator as previously discussed. Alternate nail decorating tool 40 consists of an elongated member 42 having opposite ends 44 and 46. A foam pad 48 is provided on end 46 of elongated member 42, and a scrapper 50 is formed on opposite end 50. Foam pad 48 is adapted to apply nail polish in a non-uniform fashion, and, like the previous embodiment, consists of a foam having non-uniform density and cell structure. As with the previous embodiment, natural sponge is preferably used in the construction of foam pad 48. The combination of scrapper 50 with non-uniform applicator pad 48 on the same elongated member permits the user to more easily switch between the two tools when decorating the finger nails. This is particularly useful since the user may wish to periodically remove portions of the nail polish layer (not shown) applied using applicator 48 in order to create the desired decorative effect.

Figure 5:
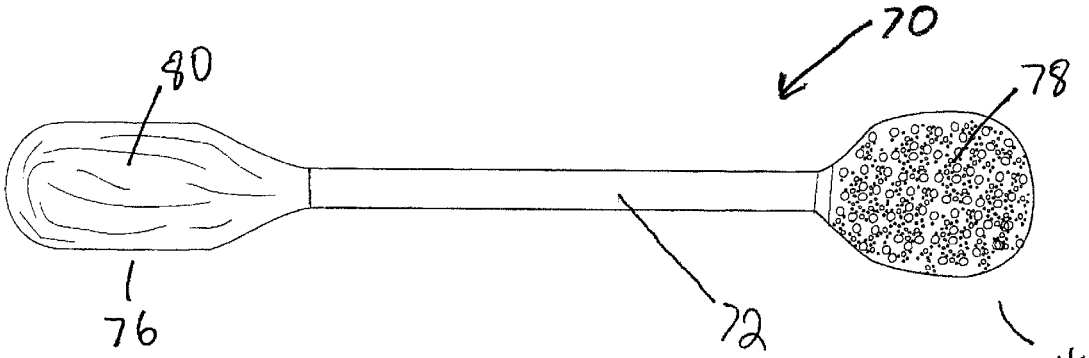
FIG. 5 is a side view of another embodiment of a nail polish applicator made in accordance with the present invention.

An alternate embodiment of the present invention is shown if FIG. 5. Nail polish applicator tool 70 consists of an elongated member 72 having opposite ends 74 and 76;

Opposite end 74 is provided with spherical foam pad 78. As in the previous embodiments, foam pad 78 is made of a foam having a non-uniform density and non-uniform cell structure. Foam pad 78 may be made of natural sponge. End 76 is provided with cotton swab 80 which is ideally suited to cleaning excess nail polish. It is expected that a user wishing to decorate her finger nails with the foam pad applicator tool may occasionally make mistakes and may apply too much nail polish. One way to remove the nail polish is to dissolve it using a nail polish remover such as acetone. This generally requires the user to dissolve away the excess nail polish with a cotton swab soaked in the nail polish remover. Applicator tool 70 combines the features of both the foam pad applicator and a cotton swab, thereby making the application and removal of nail polish more convenient.

Foam pad 78 of tool 70 is spherical rather than conical. A spherical applicator has the advantage of providing more surface area upon which nail polish may be adsorbed. This permits the user to apply more nail polish to the finger nails wile having to reapply polish to the applicator less often. This in turn permits the user to more quickly decorate the finger nails. Hence, a spherical foam applicator pad, while less precise than an applicator pad having a pointed end, can be a more efficient tool.

Figure 4:
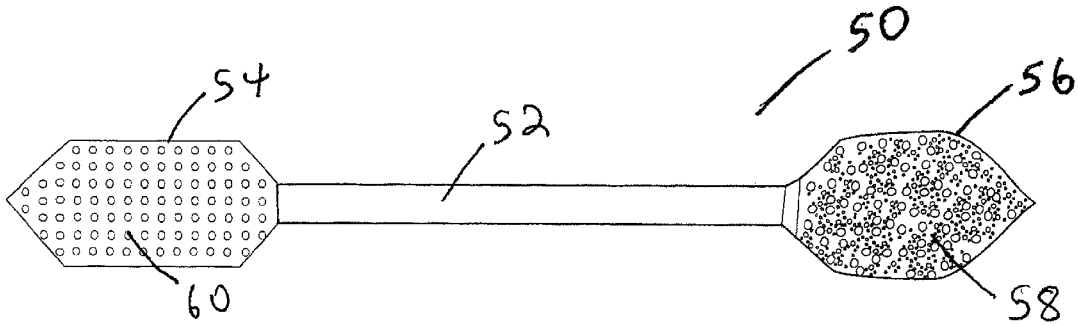
FIG. 4 is a side view of another embodiment of a nail polish applicator made in accordance with the present invention.

Since the method of the present invention involves first coating the finger nails with nail polish using a nail polish adapted to apply the polish in a uniform fashion, it would be particularly convenient to combine both types of applicators into the same tool. The embodiment shown in FIG. 4 is just such a tool. Decorating tool 50 consists of an elongated member 52 having opposite ends 54 and 56. Non-uniform applicator pad 58 is provided onto end 56 while uniform applicator pad 60 is provided onto end 54. As with the previous embodiments, applicator pad 58 consists of a foam pad having a non-uniform density and non-uniform cell structure. Again as with the previous embodiments, pad 58 is preferably constructed form natural sponge. Applicator pad 60 may comprise any applicator pad which is specifically designed to apply nail polish as uniformly and smoothly as possible. Applicator pad 60 may comprise a foam pad having a very uniform cell structure and density. Alternatively, pad 60 may comprise a small brush having bristles. By combining both types of nail polish applicators onto the same tool, the user need only work with one tool.

A specific embodiment of the present invention has been disclosed; however, several variations of the disclosed embodiment could be envisioned as within the scope of this invention. It is to be understood that the present invention is not limited to the embodiments described above, but en compasses any and all embodiments within the scope of the following claims.

What is claimed is:

1. A fingernail decorating method comprising the steps of:

obtaining an applicator comprising:

an elongated member having a first end and a second end;

a first applicator portion on the first end comprising:

a foam brush having a non-uniform cell structure consisting of a plurality of cells of different sizes, a conical, pointed end, and an elongated, resilient plastic core;

a second applicator portion on the second end composing a bristled brush adapted to apply a substantially uniform application of nail polish;

applying a substantially uniform coating of nail polish on the fingernail using the second applicator portion;

letting the uniform coating harden;

partially saturating the first applicator portion in nail polish having a different color than the uniform coating of nail polish;

repeatedly pressing the first applicator portion against the uniformly coated nail such that the differently sized cells of the first applicator portion deposit different quantities of nail polish onto the nail;

leaving several pools of nail polish of different sizes and thicknesses on the nail;

applying some of the pools as very thin pools, such that the color of the uniform coating of nail polish partially shows through the thin pools; and leaving the uniform coating of polish exposed in several locations;

wherein, the method produces a mottled effect on the fingernails.

* * * * *